United States Patent [19]

Engle

[11] Patent Number: 4,930,232

[45] Date of Patent: Jun. 5, 1990

[54] MULTILAYER SHOE SOLE

[75] Inventor: Norman Engle, Cincinnati, Ohio

[73] Assignee: The United States Shoe Corporation, Cincinnati, Ohio

[21] Appl. No.: 329,557

[22] Filed: Mar. 28, 1989

[51] Int. Cl.[5] ..... A43B 13/38; A43B 13/40

[52] U.S. Cl. ..... 36/44; 36/71; 36/80; 128/615

[58] Field of Search ..... 36/43, 44, 71, 76 C, 36/80; 128/614, 615

[56] References Cited

U.S. PATENT DOCUMENTS

| | | | |
|---|---|---|---|
| 492,994 | 3/1893 | Sawyer . | |
| 1,741,419 | 12/1929 | Jones . | |
| 1,920,112 | 7/1933 | Shaft . | |
| 2,121,176 | 6/1938 | Shain . | |
| 2,144,330 | 1/1939 | Farrington . | |
| 2,274,205 | 2/1942 | Mann . | |
| 2,276,949 | 3/1942 | Everston . | |
| 2,598,297 | 5/1952 | Pierson . | |
| 3,009,270 | 11/1961 | Nacht | 36/44 X |
| 3,412,487 | 11/1968 | Diamant . | |
| 3,835,558 | 9/1974 | Revill . | |
| 4,187,621 | 2/1980 | Cohen . | |
| 4,231,169 | 11/1980 | Toyama et al. . | |
| 4,586,273 | 5/1986 | Chapnick | 36/44 |
| 4,631,841 | 12/1986 | Hickey . | |
| 4,633,598 | 1/1987 | Moronaga et al. | 36/44 |
| 4,633,877 | 1/1987 | Pendergast | 36/44 X |
| 4,694,590 | 9/1987 | Greenawalt . | |

FOREIGN PATENT DOCUMENTS

| | | | |
|---|---|---|---|
| 418837 | 9/1925 | Fed. Rep. of Germany | 36/43 |
| 1078079 | 5/1954 | France | 36/44 |
| 2528674 | 12/1983 | France | 36/43 |
| 1521682 | 8/1978 | United Kingdom | 36/44 |

*Primary Examiner*—James Kee Chi

*Attorney, Agent, or Firm*—Jones, Tullar and Cooper

[57] ABSTRACT

The present invention is directed to a multilayer laminate for use as a sole of a shoe. The shoe construction includes a combination of rigid support materials and polymeric foam materials of varying Shore hardness values permanently attached atop a conventional outer sole. The specific structural configuration of the material enhances the durability of the shoe and improves the comfort it provides for its wearer.

10 Claims, 4 Drawing Sheets

MULTILAYER SHOE SOLE

FIELD OF THE INVENTION

The present invention is directed to a multilayer laminate for use as the sole of a shoe. The present invention is further directed to a shoe sole construction having an inner sole with a foam composite liner adhered thereto. More specifically, the present invention is directed to a multilayer shoe sole construction comprising an inner sole having a forefoot cushion, a heel cushion and rigid heel support adhered to an insole board, and a foam composite liner constructed of foams of differing shore hardness values.

DESCRIPTION OF THE PRIOR ART

In today's active and mobile society, individuals demand a wardrobe which provides a high degree of function, durability, comfort and fashion for their many daily work and leisure activities. A great number of these activities include some form of foot-utilizing activity, whether it be standing, strolling, brisk walking or even occasional jogging.

Unfortunately, most fashion and dress shoes are not able to satisfy the varied demands of the wearer in these many activities. While maintaining at least for a short time an attractive appearance, many dress shoes cannot withstand the punishment of daily use by an active shoe wearer. Also, most dress shoes fail to provide any vehicle for resistance to the repeated impact of shock transmitted to the wearer's foot during his of her daily activity thus causing considerable pain and even possible physical injury to the wearer. Further, many dress show constructions, in sacrificing comfort for style, force the wearer to sacrifice a cushioned, comfortable "feel" for an attractive appearance.

In an effort to address the fashion shoe wearer's sophisticated demands, devices for insertion in the sole of a shoe, such as that which is disclosed in U.S. Pat. No. 4,631,841, have numerous drawbacks. First, the conventional shoe insert tends to move or shift from its desired position during use, causing the wearer discomfort. Also, the insert creates an added expense for the wearer which may be multiplied during the life of the shoe as the insert wears out and requires replacement. Further, a typical sole insert addresses only the problem of wearer comfort and does nothing to enhance the rigidity or strength of the shoe itself.

In an attempt to alleviate these difficulties, many show manufacturers have devised sole constructions having a combination of flexible and rigid materials, such as those disclosed in U.S. Pat. Nos. 3,835,558 and 4,187,621. None of the known previously disclosed shoe sole constructions, however, provide the shoe wearer with the advantageous combination of comfort, durability and impact absorption provided by the structual configuration of the multilayer shoe sole of the present invention.

BRIEF SUMMARY OF THE INVENTION

It is an object of the present invention to provide a shoe sole construction, particularly for a fashion or dress shoe.

A further object of the present invention is to provide a shoe sole construction for permanent attachment to the outer sole of a men's or women's dress shoe when the shoe is constructed.

Yet a further object of the present invention is to provide a shoe sole construction which enhances the durability of a men's or women's dress shoe.

Still yet a further object of the present invention is to provide a shoe sole construction which improves the comfort of a men's or women's dress shoe.

Another object of the present invention is to provide a shoe sole construction which absorbs the impact sustained by the foot of a dress shoe wearer when engaged in walking, strolling or other foot-utilizing activity.

The shoe sole of the present invention achieves these desired results by its believed novel combination of materials and structural configuration. More specifically, the shoe sole of the present invention achieves these results by utilizing a combination of rigid support materials and polymeric foam materials of varying shore hardness values permanently attached atop a conventional outer sole.

BRIEF DESCRIPTION OF THE DRAWINGS

While the novel features of the multilayer shoe sole in accordance with the present invention are set forth with particularity in the appended claims, a full and complete understanding of the invention may be had by referring to the detailed description of the preferred embodiment, as is set forth subsequently, and as illustrated in the accompanying drawings in which;

DESCRIPTION OF THE PREFERRED EMBODIMENTS

Figure 7:
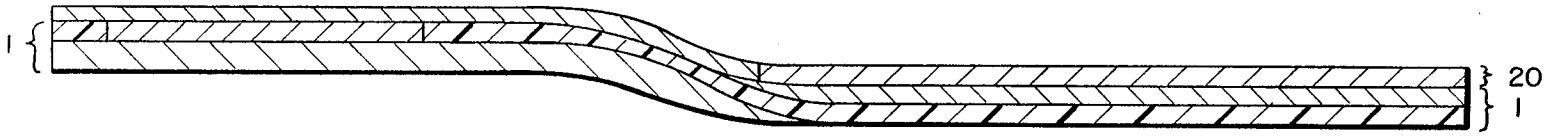
FIG. 7 is a sectional side elevation view of the first preferred embodiment of the multilayer shoe sale of the present invention.
Figure 8:
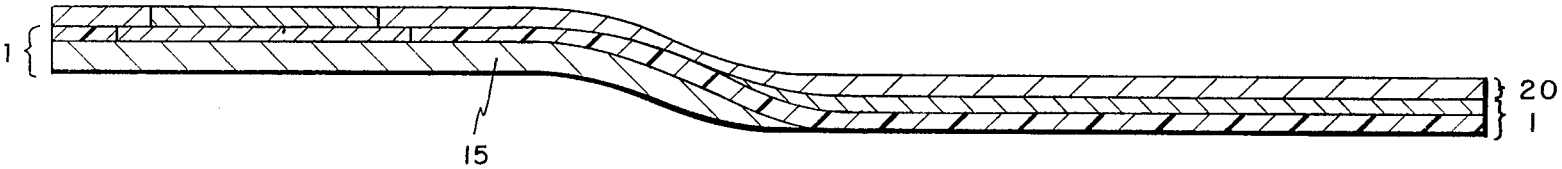
FIG. 8 is a sectional elevation view of the second preferred embodiment of the multilayer shoe sole of the present invention.

The shoe sole of the present invention in its general form includes an inner sole 1 and a foam composite liner 20, as seen in FIGS. 7 and 8. It will be understood that the structural configuration and materials of the shoe sole of the present invention in its general form can be utilized in any number of shoe sizes in both men's and women's shoes. Further, the shoe sole as discussed hereinafter can be utilized in any style of shoe, including "tie-ups" or "slip-ons" having high or low heels.

Figure 1:
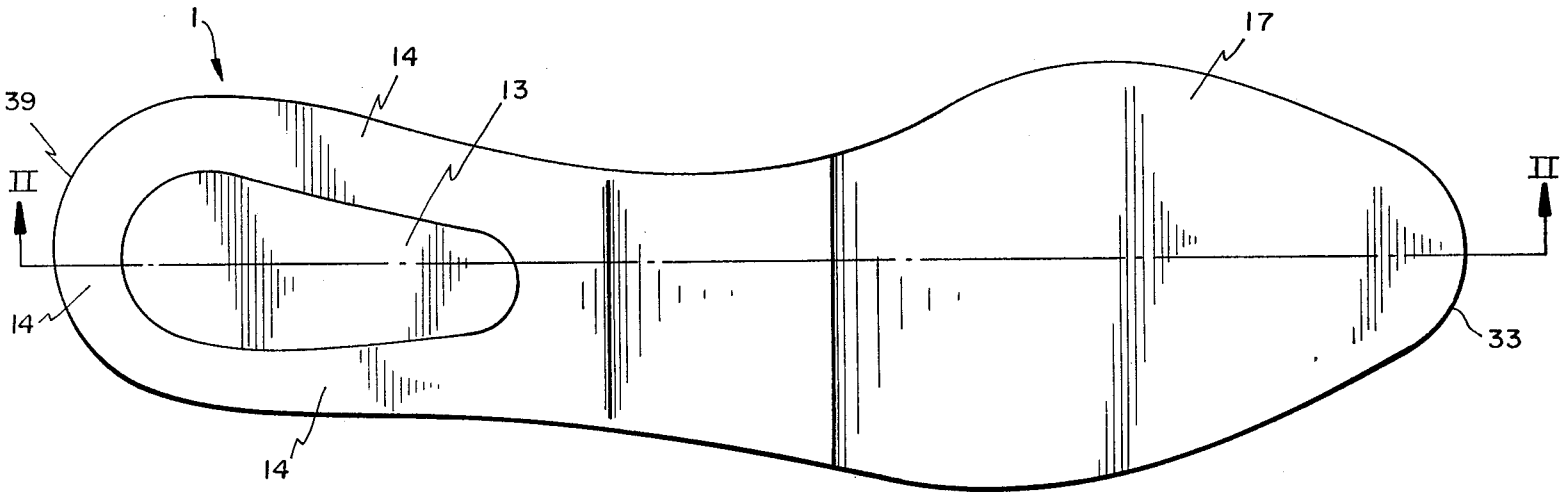
FIG. 1 is a top plan view of the inner sole of the present invention.
Figure 2:
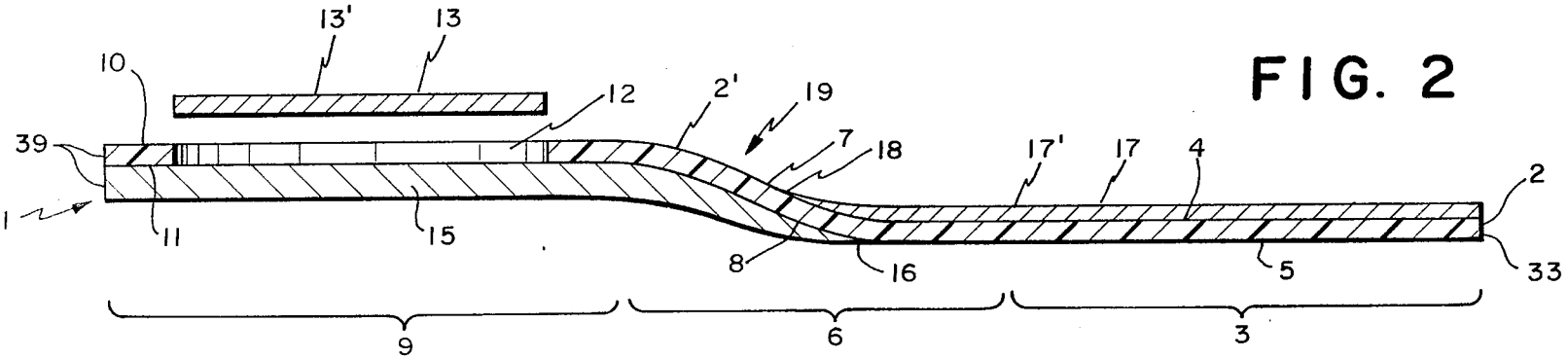
FIG. 2 is an exploded cross sectional view of the multilayer shoe sole of the present invention and taken along line II—II of FIG. 1.

The inner sole 1 of the present invention is most clearly illustrated in FIGS. 1 and 2. An insole board 2, which includes a toe portion 3, a shank portion 6 and a heel portion 9, extends the entire length of the inner sole 1 and forms its central structural layer. The insole board 2 is formed in any conventional shape to conform with the bottom of a human foot and a conventional shoe outer sole, not shown, to which the inner sole is laminated during the construction of a shoe. The insole board 2 is preferably formed from a molded mixture of cellulosic material, such as pulped paper, and glue, and is flexible after the molding process is completed. The preferred material is sold by Georgia Bonded Fibers, Buenta Vistas, Virginia, under the trademark BONTEX 47. The preferred thickness of the insole board is about 1.50 millimeters.

An aperture 12 is formed in the heel portion 9 of the insole board 2 and receives a heel cushion 13 which will be discussed in detail subsequently. Aperture 12 extends radially from the center of the heel portion 9 toward the shank portion 6 and the edges of the heel portion 9 but is centered in the heel portion 9 to provide a marginal border portion 14 of the heel portion 9 around the heel cushion 13 when this cushion 13 is inserted in the aperture 12. The marginal border portion 14 of the insole board 2 provides increased support and assists in the prevention of the wearer's ankle turning or other possible wearer injury.

A heel support 15 is adhered with a conventional adhesive to the insole board 2 and extends from a rearward edge 39 of the heel portion 9 of the insole board 2 along its bottom face 11 forward towards the toe portion 3 and terminates at a termination point 16 at the bottom face 8 of the shank portion 6 of the insole board. The heel support 15 is approximately 3.75 millimeters thick at its attachment point at the rearward edge 39 of the heel portion 9 and decreases in thickness towards its termination point 16 at the shank portion 6. The contour of the heel support 15 follows the formed shape of the insole board 2 along its outer edge.

The heel support 15 is constructed of a rigid material, preferably a molded composite of pulped paper, glue and plastic such as the rigid material produced by Lydall Industries and sold under the trademark COLONIAL TM. The rigidity of the heel support 15 provides increased structural strength in the heel of the inner sole 1, which undergoes significant stress and impact when in use in a dress shoe utilized by a wearer who does significant walking.

Referring again to FIGS. 1 and 2, the aperture 12 in the insole board 2 receives a heel cushion 13 which is formed to conform to the shape of the aperture 12. The heel cushion 13 is adhered to the face of the heel support 15 which is exposed through the aperture 12. The heel cushion 13 has a thickness which is preferably approximately equivalent to that of the insole board 2 so that, when the heel cushion 13 is received in the aperture 12, a smooth, even surface across the top surface of the heel cushion 13 and the top face 10 of the heel portion 9 of the insole board 2 is formed. The heel cushion 13 is formed from any conventional polymeric foam material, such as closed cell polyethylene, and preferably has a hardness value of between 25 Shore and 30 Shore. The hardness value of the heel cushion material is sufficient to impart shock absorbing properties to the sole of the present invention. This shock absorbing characteristic prevents the repeated impacts resulting from walking from being transmitted through the shoe and into the wearer's foot.

A forefoot cushion 17, which is preferably constructed from an approximately 2.50 millimeter thick layer of the same foam material as used for heel cushion 13, is adhered to the top face 4 of the toe portion 3 of the insole board 2. The forefoot cushion 17 conforms to the shape of the insole board 2 and extends from a forward edge 33 of the toe portion 3 along its top face 4 towards the heel portion 9 and decreases in thickness to its termination point 18 at the shank portion 6. The forefoot cushion 17, like the heel cushion 13, functions as a shock absorbing structure by lessening the amount of walking impact which is transmitted to the wearer's foot.

Figure 3:
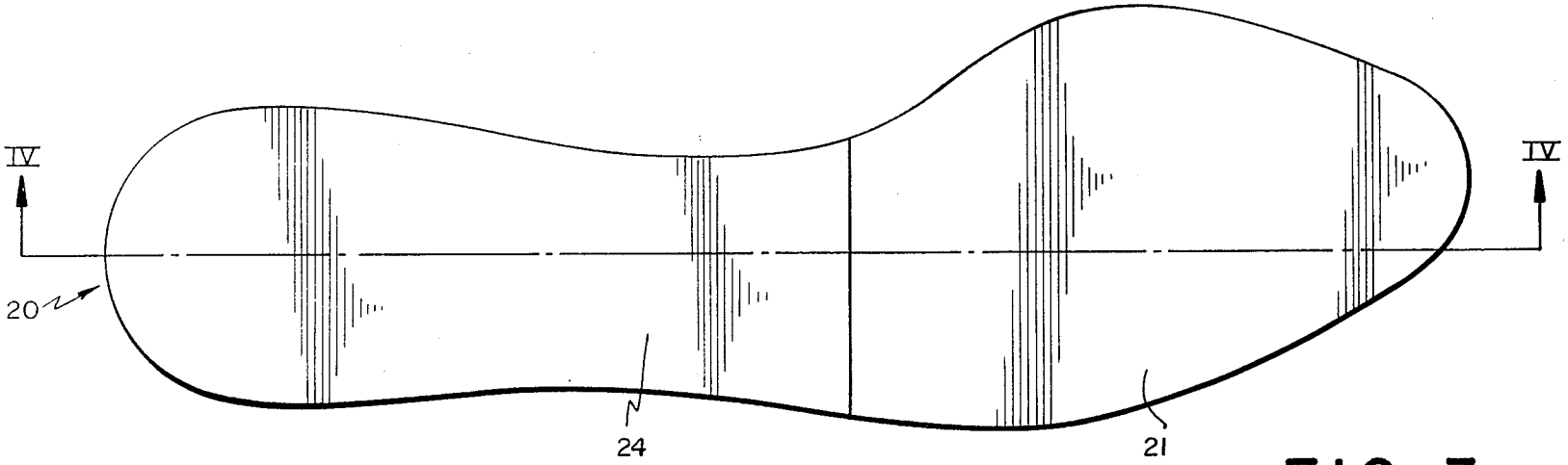
FIG. 3 is a top plan view of a first preferred embodiment of the foam composite liner of the present invention.
Figure 4:
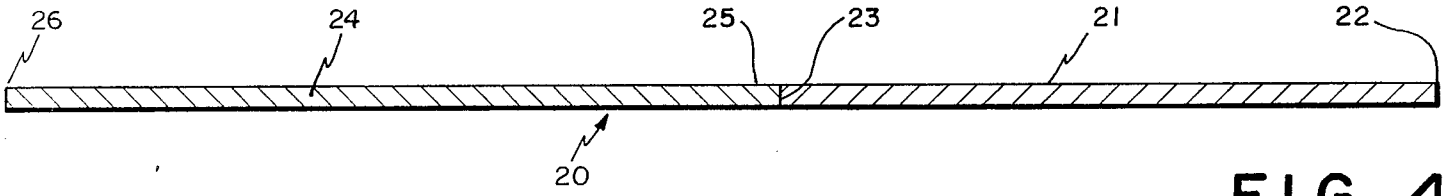
FIG. 4 is a cross sectional view of the foam composite liner of FIG. 3 and taken along line IV—IV of FIG. 3.

To the top surface of the above described inner sole 1 there is adhered with a conventional adhesive a first preferred embodiment of a foam composite liner 20 which is shown in FIGS. 3 and 4. This foam composite liner 20 includes a toe piece 21 and a heel piece 24. The toe piece 21 formed of a layer of polymeric foam material, preferably a layer about 2.50 mm in thickness of the same foam utilized for heel cushion 13 and having a hardness value of between 25 Shore and 30 Shore. The heel piece 24 is attached with a conventional adhesive along its forward edge 25 to a rearward edge 23 of the toe piece 21. Toe piece 21 and heel piece 24 are preferably attached to each other at the shank portion 6 of the insole board 2 when the foam composite layer 20 is positioned atop the insole board 2. The heel piece 24 is constructed of a layer of polymeric foam material having a Shore hardness value significantly lower than that of the foam of which the toe piece 21 is constructed. The preferred heel piece 24 has a thickness of approximately 2.50 millimeters and is constructed of a polymeric foam having a hardness value of between about 20 Shore and about 25 Shore.

The heel piece 24 is constructed of this lower hardness value foam in order to provide the wearer with a cushioned, resilient "feel", as the more rigid layers below the heel piece 24, while providing structural strength and impact absorption, may not provide the desired sensation of softness or comfort for the wearer's foot.

Figure 5:
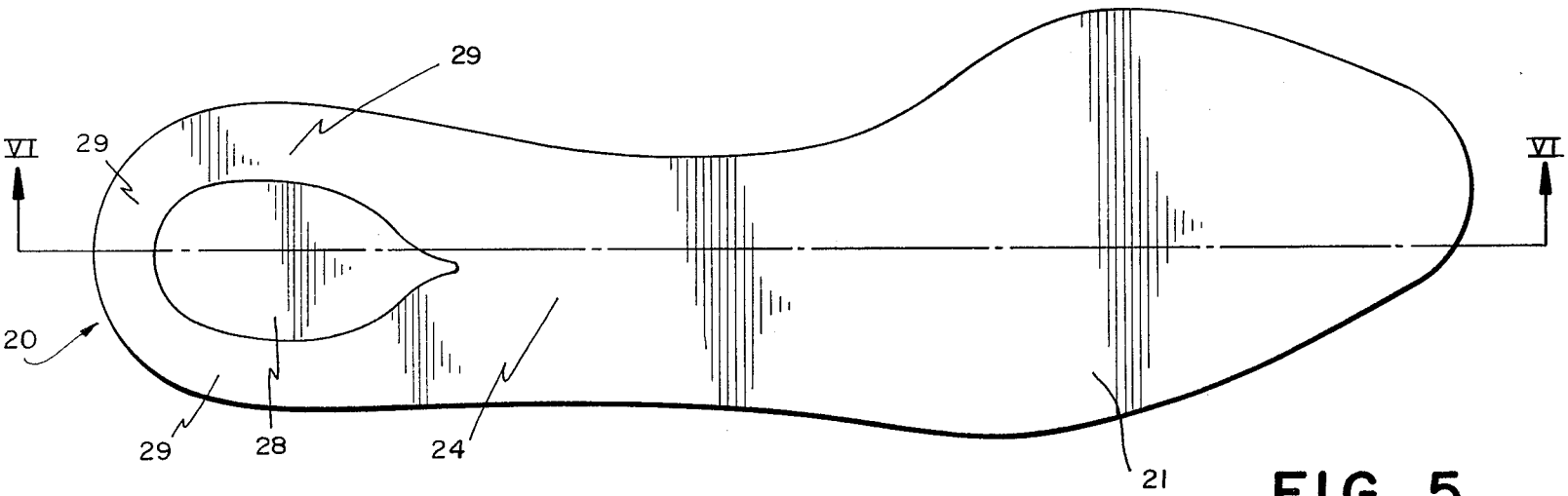
FIG. 5 is a top plan view of a second preferred embodiment of the foam composite liner of the present invention.
Figure 6:
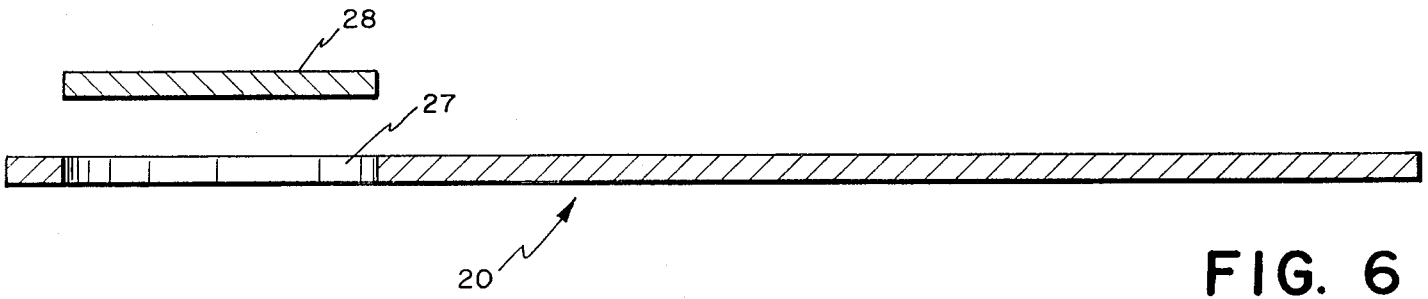
FIG. 6 is an exploded cross sectional view of the foam composite liner of FIG. 5 and taken along line VI—VI of FIG. 5.

A second preferred embodiment for the foam composite liner 20 is shown in FIGS. 5 and 6. In this embodiment, the toe piece 21 and heel piece 24 are integral and are formed of the same polymeric foam material, preferably a layer of polmer foam of approximately 25 Shore to 30 Shore hardness and about 2.50 mm thickness. A cutout 27 is formed in the heel piece 24 and a foam liner insert 28 of the same shape, size and thickness of the cutout 27, is inserted and bonded in the cutout 27 with a conventional adhesive. The cutout 27 is preferably tear-shaped, and is generally centered in the heel piece 24 with its wider end nearer the rearward edge of the heel piece 24 thus leaving at least a marginal border 29 about the edge of heel piece 24 and surrounding insert 28 when this insert is placed in the the cutout 27. The foam liner insert 28 is cooperatively shaped with cutout 27 and is constructed of a polymeric foam material of a lower Shore hardness value than that material from which the heel piece 24 and integral toe piece 21 are formed. Preferably, a polymeric foam of hardness between about 20 Shore and about 25 Shore is utilized for the foam liner insert 28. The lower hardness foam insert provides a more cushioned resilient "feel" for the wearer's foot and therefore is considerably more comfortable.

The overall construction of the multilayer shoe sole of the present invention is shown in FIGS. 7 and 8. The foam composite liner 20 is positioned atop the innersole 1 and is bonded with a conventional adhesive to the top surface of the inner sole 1 on the exposed surfaces 17', 2' and 13' of the forefoot cushion 17, insole board 2 and heel cushion 13. The resulting laminate provides a shoe sole construction, particularly for use in a fashion and dress shoe, which is easily and economically manufactured, durable and provides the shoe wearer with a comfortable combination of foot support, even weight distribution and impact absorption.

While the shoe sole of the instant invention has been described in detail and with specific references thereof, it is to be understood that various changes and modifications that do not depart from the spirit and scope of the present invention may be made. For example, the thicknesses of the various layers can be varied to impart additional rigidity, shock absorption and/or cushioning effect for improved wearer comfort or durability. Further, various polymeric foams may be utilized for the forepart cushion, heel cushion and composite foam liner so long as their Shore hardness values and relative hardness relationships as herein disclosed are not substantially altered and the desired characteristics are maintained.

I claim:

1. A multilayer shoe sole, comprising:

(A) an inner sole, having a top surface and a bottom surface, said inner sole including
  (i) an insole board having a toe portion, a shank portion and a heel portion, each side portion having a top face and a bottom face;
  (ii) an aperture formed in said heel portion of said insole board;
  (iii) a heel cushion contained in said aperture, said cushion including an exposed surface;
  (iv) a rigid heel support adhered to said insole board and extending from said bottom face of said heel portion to said bottom face of said shank portion; and
  (v) a forefoot cushion, including an exposed surface, said cushion being adhered to said insole board and extending from said top face of said toe portion to said top face of said shank portion;

(B) a foam composite liner positioned on said top surface of said inner sole, said liner comprising
  (i) a toe piece of a first polymeric foam material having a first Shore hardness value, said toe piece having a forward edge and a rearward edge, and,
  (ii) a heel piece of a second polymeric foam material having a second Shore hardness value, said heel piece having a forward edge and a rearward edge, said forward edge of said heel piece being adhered to said rearward edge of said toe piece, said first Shore hardness value being higher than said second Shore hardness value; and (C) means for adhering said foam composite liner to said top surface of said inner sole along the entire said exposed surface of said heel cushion, the entire said exposed surface of said forefoot cushion and said top face of said insole board.

2. The shoe sole of claim 1, wherein said first polymeric foam material has a hardness value of between about 25 Shore and about 30 Shore.

3. The shoe of claim 1 wherein said second polymeric foam material has a hardness value of between 20 Shore and 25 Shore.

4. The shoe sole of claim 2 wherein said second polymeric foam material has a hardness value of between about 20 Shore and about 25 shore.

5. The shoe sole of claim 1 wherein said rearward edge of said toe piece of said foam composite liner and said forward edge of said heel piece of said foam composite liner are adhered to each other at said top surface of said shank portion of said insole board.

6. A shoe sole, comprising:

(A) an inner sole, having a top surface and a bottom surface, said inner sole including
  (i) an insole board having a toe portion, a shank portion and a heel portion, each said portion having a top face of and a bottom face;
  (ii) an aperture formed in said heel portion of said insole board;
  (iii) a heel cushion contained in said aperture, said cushion including an exposed surface;
  (iv) a rigid heel support adhered to said insole board and extending from said bottom face of said shank portion; and
  (v) a forefoot cushion, including an exposed surface, said cushion adhered to said insole board and extending from said top face of said toe portion to said top face of said shank portion;

(B) a foam composite liner position atop said inner sole, said liner comprising:
  (i) a toe piece of a first polymeric foam material having a first Shore hardness value;
  (ii) a heel piece of said first polymeric foam material integral with said toe piece;
  (iii) a cutout portion formed in said heel piece, and
  (iv) an insert of a second polymeric foam material having a second Shore hardness value contained in said cutout portion of said heel piece, said second Shore hardness value being less than that of said first Shore hardness value; and, (C) means for adhering said foam composite liner to said top surface of said inner sole along said exposed surface of said heel cushion, said exposed surface of said forefoot cushion and said top face of said insole board.

7. The shoe sole of claim 6, wherein said first polymeric material has a hardness of between about 25 Shore and about 30 Shore.

8. The shoe sole of claim 6 wherein said second polymeric foam material has a hardness of between about 20 Shore and about 25 Shore.

9. The shoe sole of claim 7 wherein said second polymeric foam material has a hardness of between about 20 Shore and about 25 Shore.

10. The shoe sole of claim 6 wherein said cutout and said foam insert contained in said cutout are tear-drop shaped.

* * * * *